US005429104A

United States Patent [19]

Kondou

[11] Patent Number: 5,429,104

[45] Date of Patent: Jul. 4, 1995

[54] AIR-FUEL RATIO CONTROL APPARATUS FOR INTERNAL COMBUSION ENGINE

[75] Inventor: Katsuhiko Kondou, Himeji, Japan

[73] Assignee: Mitsubishi Denki Kabushiki Kaisha, Tokyo, Japan

[21] Appl. No.: 213,749

[22] Filed: Mar. 16, 1994

[30] Foreign Application Priority Data

Mar. 26, 1993 [JP] Japan ..... 5-068622

[51] Int. Cl.[6] ..... F02D 41/14

[52] U.S. Cl. ..... 123/692

[58] Field of Search ..... 123/691, 692

[56] References Cited

U.S. PATENT DOCUMENTS 4,703,735 11/1987 Minamitani et al. ..... 123/692

4,984,551 1/1991 Moser ..... 123/692

FOREIGN PATENT DOCUMENTS 148930 11/1979 Japan .

259741 12/1985 Japan .

*Primary Examiner*—Tony M. Argenbright

*Attorney, Agent, or Firm*—Sughrue, Mion, Zinn, Macpeak and Seas

[57] ABSTRACT

An air-fuel ratio control apparatus for an internal combustion engine, for example, a V-type engine, for accurately controlling the air-fuel ratio of a first cylinder group and that of a second cylinder group. The air-fuel ratio control apparatus is arranged such that air fuel ratios of respective cylinder groups are controlled to be phase different to prevent changes in rotational speed and improve the effect of a trinary catalyst.

4 Claims, 11 Drawing Sheets

AIR-FUEL RATIO CONTROL APPARATUS FOR INTERNAL COMBUSION ENGINE

BACKGROUND OF THE INVENTION

1. Field of the Invention

This invention relates to an air-fuel ratio control apparatus for an internal combustion engine, for example, a V-type multi-cylinder engine composed of two cylinder groups, and more particularly to an air-fuel ratio control apparatus for an internal combustion engine of a type arranged in such a manner that air-fuel ratios of cylinder groups respectively are controlled to different phases to prevent change in rotations and improve an effect of a trinary catalyst.

2. Description of the Related Art

Hitherto, an air-fuel ratio control apparatus of the foregoing type has been arranged as disclosed in Japanese Patent Publication No. 60-53771 in such a manner that a integral output means controls the air-fuel ratio of a first cylinder group in accordance with a signal transmitted from an air-fuel ratio sensor disposed in only an exhaust pipe of a first cylinder group, and a rectangular wave signal having an inverse phase to that of the integral output means is used to control a second cylinder group. As a result, the concentrations of the air-fuel ratios of the two cylinder groups are made different.

FIG. 9 is a structural view which illustrates an air-fuel ratio control apparatus for an internal combustion engine adapted to a V-type and 8-cylinder engine disclosed as described above. Referring to FIG. 9, reference numeral 1 represents an engine body composed of a first cylinder group 1*a* and a second cylinder group 1*b*.

An ECU (an electronic fuel injection control unit) 8A comprises a main calculating circuit 81A, a correction circuit 87*a* for making fuel injection signal C1 to be supplied to the first cylinder group 1*a* and a correction circuit 87*b* for making fuel injection signal C2 to be supplied to the second cylinder group 1*b*. The correction circuits 87*a* and 87*b* also have functions of operating injectors (omitted from illustration) of the corresponding cylinder groups 1*a* and 1*b*.

An air-fuel ratio sensor 15 is disposed in an exhaust pipe 14*a* of the first cylinder group 1*a* to detect the air-fuel ratio of a mixed gas in the exhaust pipe 14*a*. Trinary catalysts 16*a* and 16*b* are disposed downstream from the corresponding exhaust pipes 14*a* and 14*b* to purify the exhaust gas in each of the exhaust pipes 14*a* and 14*b*. Reference numeral 25 represents a known feedback control circuit for comparing and integrating air-fuel ratio signal AF supplied from the air-fuel ratio sensor 15. Reference numeral 26 represents a correction control circuit for generating inverse phase signal B2 to be supplied to the second cylinder group 1*b* in response to an output signal transmitted from the feedback control circuit 25.

The feedback control circuit 25 includes a comparison circuit and an integrating circuit, the feedback control circuit 25 transmitting output signal B1 to be received by the correction circuit 87*a* disposed in the ECU 8A. The inverse phase signal B2 is, by way of the correction control circuit 26, received by the correction circuit 87*b*.

Referring to a waveform graph shown in FIG. 10, the operation of the conventional air-fuel ratio control apparatus for an internal combustion engine shown in FIG. 9 will now be described. It should be noted that the ECU 8A receives signals transmitted from various sensors (omitted from illustration) which detect various states of the operation.

First, the main calculating circuit 81A disposed in the ECU 8A calculates the basic quantity of fuel to be injected per unit rotation of the engine in accordance with an air suction quantity or the like detected by an air flow sensor (omitted from illustration).

Then, the correction circuits 87*a* and 87*b* correct the basic air injection quantity in accordance with the temperature of water for cooling the engine detected by a temperature sensor (omitted from illustration) and so forth to supply information about the corrected quantity to the injectors of the cylinder groups 1*a* and 1*b* as fuel injection signals C1 and C2.

The first cylinder group 1*a* is, at this time, feedback-controlled in response to the air-fuel ratio signal AF so that the air-fuel ratio in the exhaust pipe 14*a* is adjusted to satisfy a theoretical air-fuel ratio (14.7). The air-fuel ratio of the second cylinder group 1*b* is open-loop-controlled as to satisfy the theoretical air-fuel ratio in such a manner that it is increased and/or decreased in an inverse phase with respect to the air-fuel ratio of the first cylinder group 1*a*.

That is, the correction circuit 87*a* performs calculations for the correction in response to the output signal B1 transmitted from the feedback control circuit 25, while the correction circuit 87*b* performs calculations for the correction in response to the inverse phase signal B2 supplied by way of the correction control circuit 26. The correction control circuit 26 superposes the average of rectangular wave output signals and that of integral output signals in inverse phase, the levels of which are lowered when the integral output signals transmitted from the feedback control circuit 25 are increased and which are raised when the same are decreased. The correction control circuit 26 generates an inverse phase signal B2 to be supplied to the correction circuit 87*b*.

Therefore, the fuel injection signals C1 and C2 are formed into waveforms that increase and decrease in mutually inverse phases as shown in FIG. 10.

Since the alternate supply of the thick and thin air-fuel ratio air to each of the cylinder groups 1*a* and 1*b* realizes the average theoretical air-fuel ratio in the trinary catalysts 16*a* and 16*b*, an efficiency of purifying the exhaust gas can be improved. That is, HC and CO generated in a rich control mode can be, in an average manner, mixed with NOx generated in a lean control mode. Since factors, which vary the engine revolutions between the two cylinder groups 1*a* and 1*b*, can be offset, the change in the engine revolutions can be prevented.

However, if specifications or operation conditions are different such that sucked air is irregularly distributed due to machining deviations between the two cylinder groups 1*a* and 1*b* or due to the structure and layout of the suction pipes or such that the temperature of the sucked air or the engine is different due to the structure and the layout of the cooling water passage and the exhaust pipes 14*a* and 14*b*, the structure made such that the air-fuel ratio in the second cylinder group 1*b* is open-loop-controlled results in that the air-fuel ratio of the second cylinder group 1*b* is not always controlled to a predetermined theoretical air-fuel ratio. Therefore, there arises a risk that the improvement in the efficiency of purifying exhaust gas and prevention of the change in the revolutions of the engine cannot be realized.

If the engine speed is accelerated or decelerated, a state is sometimes continued in which both of the air-fuel ratios of the two cylinder groups 1*a* and 1*b* are rich (or lean).

An example state will now be considered in which both of the air-fuel ratio of the cylinder group 1*a* and that of the cylinder group 1*b* are rich. Since the first cylinder group 1a is feedback-controlled at this time in response to the air-fuel ratio signal AF supplied from the air-fuel ratio sensor 15, the control is so performed that the air-fuel ratio of the first cylinder group 1*a* is made lean in order to approximate the air-fuel ratio to the theoretical air-fuel ratio.

On the contrary, the air-fuel ratio of the second cylinder group 1*b* is controlled in an inverse direction to the direction in which that of the first cylinder group 1*a* is controlled. It leads to a fact that the air-fuel ratio of the second cylinder group 1*b* is controlled to the rich side though the actual air-fuel ratio is rich.

Also a state can be realized such that the air-fuel ratio of the second cylinder group 1*b* is made lean though a lean air-fuel ratio has been realized.

FIG. 11 is a waveform graph which shows changes of the fuel injection signals C1 and C2 taken place at the time of the acceleration of the engine, wherein the acceleration has taken place at time t0.

Assuming that the state where both of the air-fuel ratios of the respective cylinder groups 1*a* and 1*b* have been continued in the foregoing case, the air-fuel ratio of the first cylinder group 1*a* is approximated to the theoretical air-fuel ratio by continuously increasing, toward the rich (thick) side, the fuel injection signal C1 to be supplied to the first cylinder group 1*a*. On the other hand, the fuel injection signal C2 to be supplied to the second cylinder group 1*b* is undesirably decreased toward the lean (thin) side due to the inverse phase control. That is, the air-fuel ratio of the second cylinder group 1*b* is controlled to be further thinned though the air-fuel ratio is thin.

If the state shown in FIG. 11 has been realized, the air-fuel ratio of the second cylinder group 1*b* is excessively deviated from the aimed air-fuel ratio. What is worse, the air-fuel ratios of the two cylinder groups 1*a* and 1*b* are considerably varied. As a result, deterioration in the purifying efficiency realized by the ternary catalysts 16*a* and 16*b* worsens the exhaust gas and changes the engine speed.

As described above, the conventional air-fuel ratio control apparatus for an internal combustion engine has been arranged in such a manner that the air-fuel ratio of the second cylinder group 1*b* is not feedback-controlled because the exhaust pipe 14*b* has no air-fuel ratio sensor but it is open-loop-controlled in response to the air-fuel ratio signal AF supplied from the air-fuel ratio sensor 15 disposed in the exhaust pipe 14*a* for the first cylinder group 1*a*.

Therefore, if the characteristics of the air-fuel ratio of the cylinder group 1*a* and that of the cylinder group 1*b* are considerably different from each other due to the irregular distribution of sucked air caused from the machining deviations between the two cylinder groups 1*a* and 1*b*, the structure and layout of the suction pipes, due to the difference in the temperature of sucked air or the engine temperature between the same due to the layout of the cooling water passage and the exhaust pipes 14*a* and 14*b* or due to difference in the operation conditions, there rises a problem in that a state is sometimes realized wherein the rich or lean air-fuel ratio is continued.

A state is sometimes continued wherein both of the fuel air ratios of the two cylinder groups 1*a* and 1*b* are rich (or lean) at the time of accelerating or decelerating the engine speed. The fact, that the air-fuel ratio of the second cylinder group 1*b* is controlled in the inverse direction to the direction in which the air-fuel ratio of the first cylinder group 1*a* is controlled, causes the air-fuel ratio of the second cylinder group 1*b* to be made further rich though the air-fuel ratio has been made rich or that to be made further lean though the air-fuel ratio has been made lean. As a result, the air-fuel ratio of the second cylinder group 1*b* is considerably deviated from an aimed air-fuel ratio and the air-fuel ratios of the two cylinder groups 1*a* and 1*b* are made to be considerably different from each other. Therefore, a problem arises in that the deterioration in the purifying efficiency of the ternary catalysts 16*a* and 16*b* worsens the characteristics of the exhaust gas and the rotational speed is changed.

SUMMARY OF THE INVENTION

The present invention is directed to overcome the foregoing problems and therefore an object of the same is to obtain an air-fuel ratio control apparatus for an internal combustion engine that is capable of ideally and accurately controlling the air-fuel ratio of a first cylinder group and that of a second cylinder group.

As a result of the foregoing structure, the air-fuel ratio of the first cylinder group and that of the second cylinder group can ideally and accurately controlled, the purifying efficiency of the trinary catalyst can be improved and change in the engine revolutions can be prevented.

According to a form of the present invention, there is provided an air-fuel ratio control apparatus for an internal combustion engine for controlling the air-fuel ratio of a first cylinder group and a second cylinder group, the air-fuel ratio control apparatus for an internal combustion engine comprising: a first air-fuel ratio sensor disposed in an exhaust system of the first cylinder group; a second air-fuel ratio sensor disposed in an exhaust system of the second cylinder group; first air-fuel ratio control means for controlling the air-fuel ratio of the first cylinder group to be a predetermined air-fuel ratio in accordance with a first air-fuel ratio signal supplied from the first air-fuel ratio sensor; second air-fuel ratio control means for controlling the air-fuel ratio of the second cylinder group to be a phase different from the phase of the air-fuel ratio of the first cylinder group in accordance with the first air-fuel ratio signal; and air-fuel ratio correction means for correcting the air-fuel ratio of the second cylinder to be a predetermined air-fuel ratio in accordance with a second air-fuel ratio signal supplied from the second air-fuel ratio sensor.

As a result, the purifying efficiency of the trinary catalyst can be improved and the change in the engine revolutions can be prevented.

In one form of the invention, the air-fuel ratio correction means comprises inverse phase discrimination means for discriminating whether or not the air-fuel ratio of the first cylinder group and that of the second air-fuel ratio are in an inverse phase state; and correction means for correcting the phase of the air-fuel ratio of the second cylinder group to be inverse to the phase of the air-fuel ratio of the first cylinder group if the air-fuel ratio of the first cylinder group and that of the second cylinder group are not inverse phase state in accordance with the results of discriminations made by the inverse phase discrimination means.

As a result, the purifying efficiency of the trinary catalyst can be improved and the change in the engine revolutions can be prevented.

Preferably, the air-fuel ratio control apparatus for an internal combustion engine further comprising a common exhaust pipe for collecting the exhaust system of the first cylinder group and that of the second cylinder group, and a trinary catalyst disposed downstream from the common exhaust pipe.

As a result, the purifying efficiency of the trinary catalyst can be improved, the change in the engine revolutions can be prevented, the air-fuel ratio can properly be controlled even if the internal combustion engine is being accelerated or the decelerated.

Preferably, the air-fuel ratio control apparatus for an internal combustion engine further comprises: predetermined air-fuel ratio state discrimination means for discriminating whether or not the state of the air-fuel ratio of the first cylinder group is included in a predetermined range; air-fuel ratio control switch means for controlling the air-fuel ratio of the second cylinder group to be a predetermined air-fuel ratio in accordance with only the second air-fuel ratio signal if the state of the air-fuel ratio of the first cylinder group is deviated from the predetermined range in accordance with the result of a discrimination made by the air-fuel ratio state discrimination means.

DESCRIPTION OF THE PREFERRED EMBODIMENT

First Embodiment

Figure 1:
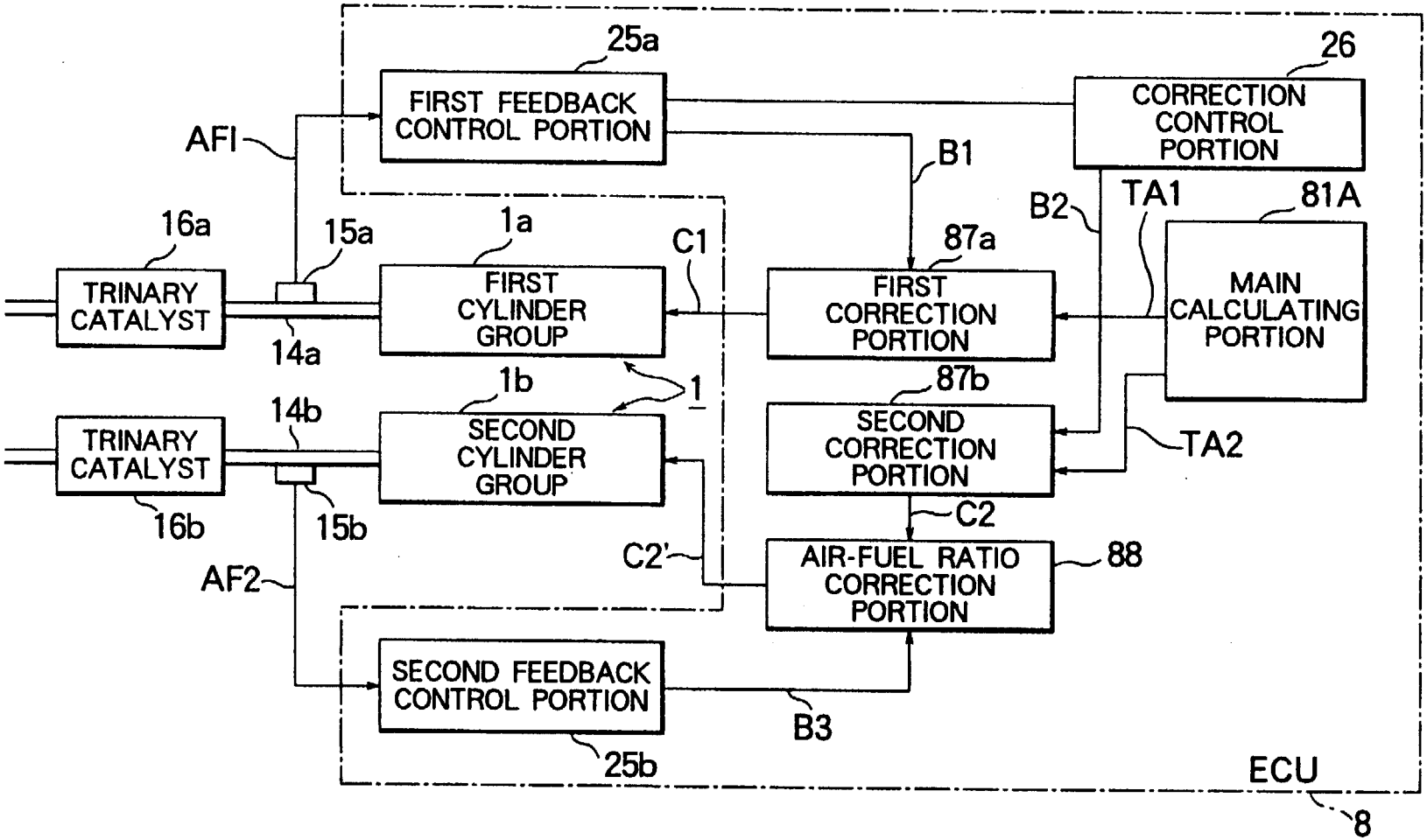
FIG. 1 is a functional block diagram which illustrates a first embodiment of the present invention.
Figure 2:
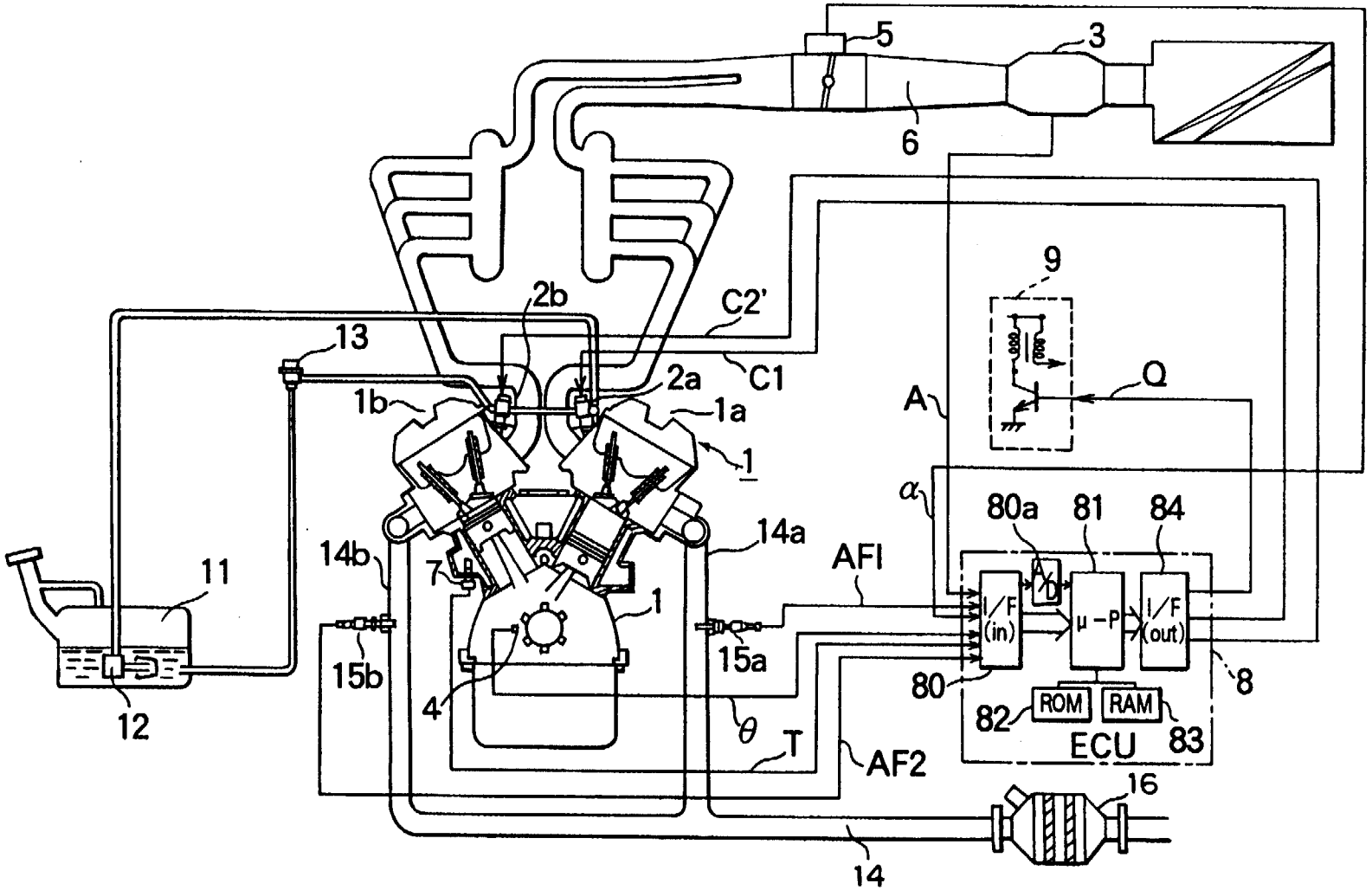
FIG. 2 is a structural view which illustrates another example of the first embodiment of the present invention.

A first embodiment of the present invention will now be described with reference to the drawings. FIG. 1 is a functional block diagram which illustrates an example of the schematic structure of the first embodiment of the present invention. FIG. 2 is a structural view which illustrates, in a cross sectional view in part, an example of a case where a trinary catalyst is used commonly in the first embodiment of the present invention.

Figure 9:
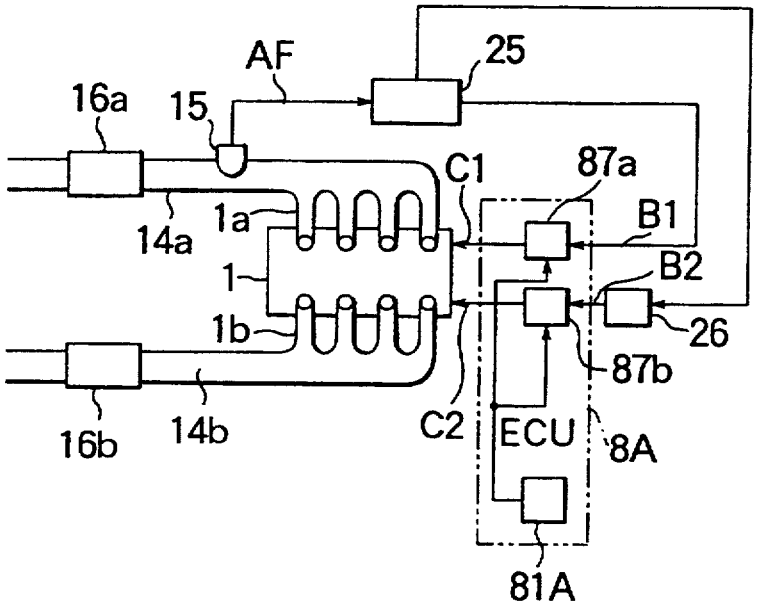
FIG. 9 PRIOR ART
FIG. 9 is a structural view which illustrates a conventional air-fuel ratio control apparatus for an internal combustion engine.
Figure 10:
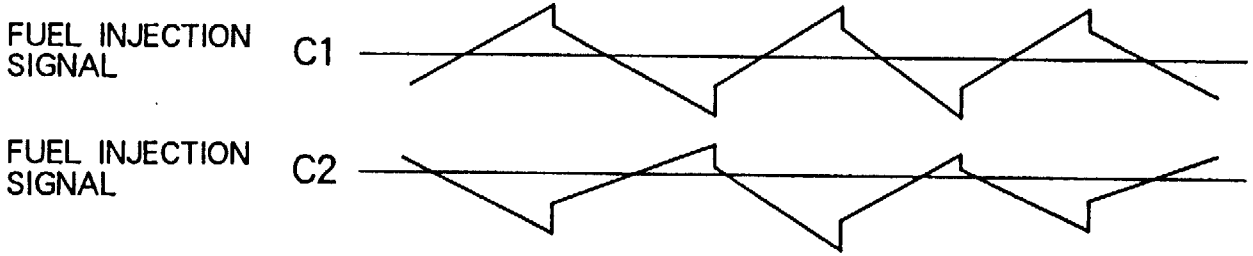
FIG. 10 PRIOR ART
FIG. 10 is a waveform graph which illustrates a usual fuel injection signal in an inverse phase.
Figure 11:
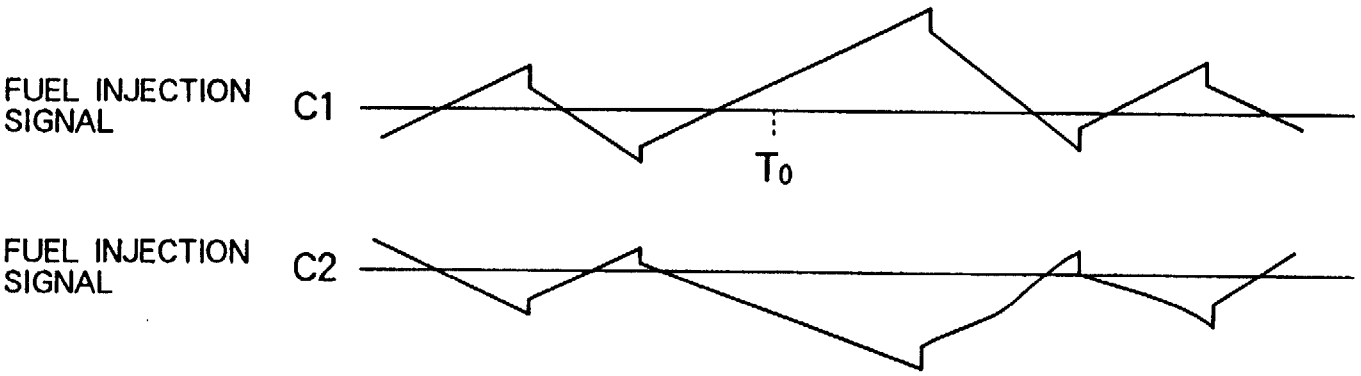
FIG. 11 PRIOR ART
FIG. 11 is a waveform graph which illustrates a second air-fuel ratio control operation to be performed by the conventional air-fuel ratio control apparatus for an internal combustion engine when the internal combustion engine is being accelerated.

Referring to FIG. 1, reference numerals 1, 1*a*, 1*b*, 14*a*, 14*b*, 16*a*, 16*b*, 26, 81A, 87*a* and 87*b* represent the same elements as the foregoing structure (see FIG. 9). Reference numerals 8, 15*a* and 25 respectively correspond to the ECU 8A, the air-fuel ratio sensor 15 and the feedback control circuit 25.

Referring to FIG. 2, reference numerals 1, 1*a*, 1*b*, 14*a* and 14*b* represent the same elements as the foregoing structure. Reference numerals 8, 15*a* and 16 respectively correspond to the ECU 8A, the air-fuel ratio sensor 15 and the trinary catalyst 16*a* (or 16*b*).

Referring to FIG. 1, the first air-fuel ratio sensor 15*a* is disposed in the exhaust pipe (exhaust system) 14*a* of the first cylinder group 1*a* to detect the air-fuel ratio of exhaust gas in the exhaust pipe 14*a*. The second air-fuel ratio sensor 15*b* is disposed in the exhaust pipe (exhaust system) 14*b* of the second cylinder group 1*b* to detect the air-fuel ratio in the exhaust pipe 14*b*.

The electronic control unit (ECU) 8 includes a first feedback control portion 25*a* for comparing and integrating first air-fuel ratio signal AF1, a second feedback control portion 25*b* for comparing and integrating second air-fuel ratio signal AF2, and the correction control portion 26 for making the inverse phase signal B2 from the output signal transmitted from the feedback control portion 25*a*.

A main calculating portion 81A in the ECU 8 calculates basic fuel injection quantities TA1 and TA2 to be supplied to the corresponding cylinder groups 1*a* and 1*b* in response to various signals transmitted from sensors. The first and second correction portions 87*a* and 87*b* correct the corresponding basic fuel injection quantities TA1 and TA2 in response to the output signal B1 transmitted from the first feedback control portion 25*a* and the inverse phase signal B2 to make the fuel injection signals C1 and C2.

The first feedback control portion 25*a*, the main calculating portion 81A and the first correction portion 87*a* form a first air-fuel ratio control means for controlling the air-fuel ratio of the first cylinder group 1*a* to a predetermined air-fuel ratio (theoretical air-fuel ratio) in response to the first air-fuel ratio signal AF1 supplied from the first air-fuel ratio sensor 15*a*.

The first feedback control portion 25*a*, the correction portion 26, the main calculating portion 81A and the second correction portion 87*b* form a second air-fuel ratio control means for controlling the air-fuel ratio of the second cylinder group 1*b* to be the inverse phase with respect to the phase of the air-fuel ratio of the first cylinder group 1*a* in response to the first air-fuel ratio signal AF1.

An air-fuel ratio correction means 88 disposed in the ECU 8 corrects the fuel injection signal C2 as to generate a corrected fuel injection signal C2' to be supplied to the second cylinder group 1b. In accordance with output signal B3 supplied from the second feedback control portion 25 and in response to a second air-fuel ratio signal AF2 supplied from the second air-fuel ratio sensor 15b, the air-fuel ratio correction means 88 corrects the air-fuel ratio of the second cylinder group 1b to a predetermined air-fuel ratio (the theoretical air-fuel ratio).

Referring to FIG. 2, the engine body, that is, an internal combustion engine 1 is a V-type 6-cylinder engine having the first cylinder groups 1a located on the right side of the drawing and composed of first, third and fifth cylinders. The second cylinder group 1b located on the left side of the same is composed of second, fourth and sixth cylinders. Reference numerals 2a and 2b represent electromagnetic injectors (fuel injection valves) for supplying fuel to the corresponding cylinder groups 1a and 1b, each of the injectors 2a and 2b being fastened to the corresponding cylinder.

An air flow sensor 3 detects air quantity A to be sucked into the internal combustion engine 1. A crank angle sensor 4 generates crank angle signal $\theta$ whenever a crank shaft of the internal combustion engine 1 is rotated by a predetermined angular degree. A throttle sensor 5 detects opening degree $\alpha$ of a sucked air throttle valve (a throttle valve) which adjusts the air quantity A to be sucked into the internal combustion engine 1. A suction pipe 6 for introducing sucked air into the internal combustion engine 1 includes the air flow sensor 3. Further, the throttle sensor 5 is disposed downstream from the air flow sensor 3.

A water-temperature sensor 7 detects temperature T of the internal combustion engine 1 and generates an output signal denoting the detected temperature T, the output signal being supplied to the ECU 8 together with detection signals, that is, the sucked air quantity A, the crank angle signal $\theta$, the throttle opening degree signal $\alpha$, the air-fuel ratio signals AF1 and AF2 supplied from the other sensors 3 to 5 and 15a to 15b.

An ignition device 9 is composed of a power transistor and an ignition coil, the ignition device 9 being operated in response to ignition signal Q supplied from the ECU 8 to the base of the power transistor as to cause an ignition plug (omitted from illustration) connected to a secondary coil of the ignition coil and disposed in each cylinder to discharge electricity.

The air-fuel ratio control apparatus according to the present invention further comprises a fuel tank 11 for supplying fuel to the injectors 2a and 2b, a fuel pump 12 for pressurizing fuel in the fuel tank 11, a fuel pressure regulator 13 for maintaining the pressure of the fuel to be supplied to the injector 2, a common exhaust pipe 14 for collecting the exhaust pipes 14a and 14b extending from the first and second cylinder groups 1a and 1b and a trinary catalyst 16 disposed downstream from the common exhaust pipe 14.

The ECU 8 controls the fuel and ignition in such a manner that it receives the sucked air quantity A, the crank angle signal $\theta$, the throttle opening degree $\alpha$, the temperature T, the air-fuel ratio signals AF1 and AF2 supplied from the various sensors and calculates the fuel injection signal C1, the corrected fuel injection signal C2' and the ignition signal Q and so forth.

The ECU 8, as shown in FIG. 1, comprises the first feedback control portion 25a, the second feedback control portion 25b, the correction control portion 26, the main calculating portion 81A, the first correction portion 87a, the second correction portion 87b, the air-fuel ratio correction portion 88 while having an input interface circuit 80 for receiving the signals supplied from the various sensors and an AD converter 80a for converting the analog signals, such as, the sucked air quantity A, the temperature T, the throttle opening degree $\alpha$, the air-fuel ratio signals AF1 and AF2 into digital signals.

A microprocessor 81 for processing the signals supplied from the various sensors comprises a ROM 82 for previously storing a calculation and operation program for the microprocessor 81, a RAM 83 for temporarily storing data during a period in which the microprocessor 81 performs the calculations, and an output interface 84 that transmits the fuel injection signal C1, the corrected fuel injection signal C2' and the ignition signal Q to operate the injectors 2a, 2b and the ignition device 9. The microprocessor 81 calculates the quantity of fuel to be supplied to the suction pipe 6 of the internal combustion engine 1, timing for operating the ignition device 9 and so forth to generate drive signals C1, C2' and the ignition signal Q to be supplied to the injectors 2a, 2b and the ignition device 9. It should be noted that the AD converter 80a, the ROM 82 and the RAM 83 may be included in the microprocessor 81.

Referring to flow charts shown in FIGS. 3 to 5, the main operation of the first embodiment of the present invention will now be described.

Figure 3:
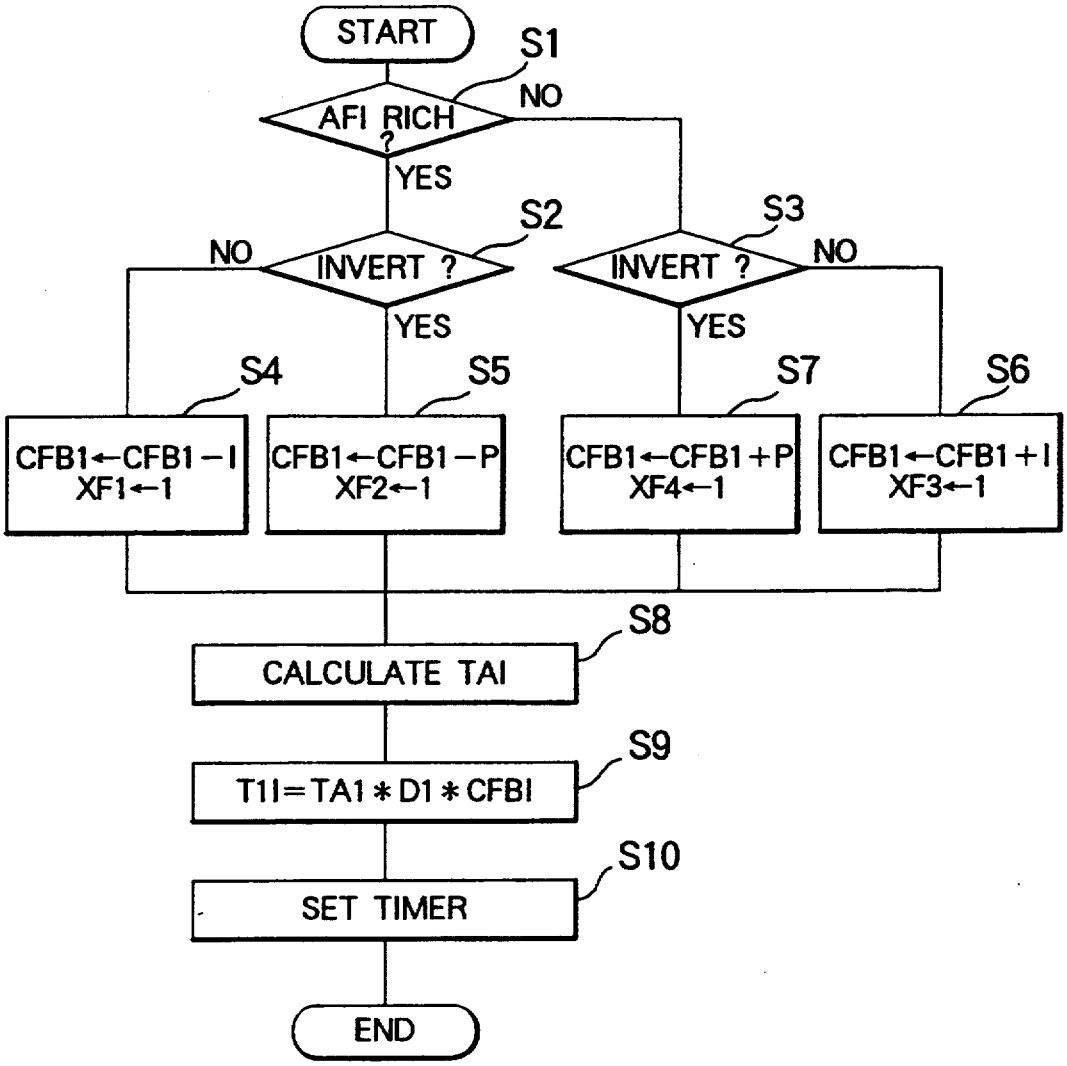
FIG. 3 is a flow chart for explaining a first air-fuel ratio control operation according to the first embodiment of the present invention.

FIG. 3 is a flow chart which explains the fuel control operation of the first cylinder group 1a, the fuel control operation being performed for each predetermined crank angle (or each predetermined time).

First, the first air-fuel ratio signal AF1 is, in step S1, subjected to a comparison with a predetermined voltage level to discriminate whether or not the level of the first air-fuel ratio signal AF1 is higher (whether or not the air-fuel ratio is rich) than the predetermined voltage. If an affirmative discrimination is made, that is, if the level of the first air-fuel ratio signal AF1 is higher than the predetermined voltage, a discrimination is made that the air-fuel ratio is thick (rich) and the flow proceeds to step S2. If a negative discrimination is made, that is, if the level of the first air-fuel ratio signal AF1 is lower than the predetermined voltage, a discrimination is made that the fuel ratio is thin (lean) and the flow proceeds to step S3.

In step S2, a discrimination is made whether or not the first air-fuel ratio signal AF1 has been inverted from the lean level to the rich level. If an affirmative discrimination has been made, that is, if the air-fuel ratio has been inverted from the lean state to the rich state, the flow proceeds to step S5 in which air-fuel ratio correction coefficient CFB1 for correcting the quantity of fuel to be injected by the injector 2a of the first cylinder group 1a is calculated to reduce the quantity as follows.

$$CFB1 \leftarrow CFB1 - P$$

where the air-fuel ratio correction coefficient CFB1 is a value about 1.0 and P is an air-fuel ratio proportional constant which is a value about 0.03.

In next step S5, flag XF2 representing the fact that the first air-fuel ratio signal AF1 has been inverted from the lean state to the rich state is set to 1, and then the flow proceeds to step S8.

If a negative discrimination has been made in step S2, that is, if the first air-fuel ratio signal AF1 in the rich state has not been inverted, the flow proceeds to step S4 in which air-fuel ratio correction coefficient CFB1 is decreased as follows.

$$CFB1 \leftarrow CFB1 - I$$

where I is an air-fuel ratio integration constant which is, for example, a value about 0.001 or less.

In step S4, flag XF1 representing the fact that the rich state of the first air-fuel ratio signal AF1 is maintained is set to 1, and then the flow proceeds to step S8.

In step S3 after the discrimination has been made that the first air-fuel ratio signal AF1 is in the lean state, a discrimination is made whether or not the first air-fuel ratio signal AF1 has been inverted from the rich state to the lean state. If an affirmative discrimination has been made, that is, if the first air-fuel ratio signal AF1 has been inverted to the lean state, the flow proceeds to step S7 in which the air-fuel ratio correction coefficient CFB1 is increased as follows.

$$CFB1 \leftarrow CFB1 + P$$

where P is the foregoing air-fuel ratio proportional constant.

In step S7, flag XF4 representing the fact that the first air-fuel ratio signal AF4 has been inverted from the rich state to the lean state is set to 1, and then the flow proceeds to step S8.

If a negative discrimination has been made in step S3, that is, if the state has not been inverted to the lean state, the flow proceeds to step S6 in which the air-fuel ratio correction coefficient CFB1 is increased as follows.

$$CFB1 \leftarrow CFB1 + I$$

where I is an air-fuel ratio integration constant.

In step S6, flag XF3 representing the fact that the lean state of the first air-fuel ratio signal AF4 is maintained is set to 1, and then the flow proceeds to step S8.

In step S8, the basic fuel injection quantity TA1 to be supplied to the first cylinder group 1*a* is calculated in accordance with the sucked air quantity A and the crank angle signal $\theta$.

In next step S9, the warming up state of the internal combustion engine 1 detected in accordance with the temperature T and the acceleration or the deceleration state of the internal combustion engine detected from the change in the throttle sensor opening degree $\alpha$ is used to obtain the fuel correction coefficient D1. Further, final fuel injection quantity TI1 to be injected into the first cylinder group 1*a* is obtained with the following equation.

$$TI1 = TA1 \times D1 \times CFB1$$

In next step S10, a timer is set to enable the fuel injection quantity TIE to be injected actually, and information about the timer is, as fuel injection signal C1 to be supplied to the injector 2*a*, is transmitted, and then the process is completed here.

A routine for controlling the injector 2*a* for the first cylinder group 1*a* is executed by the main calculating portion 81A and the first correction portion 87*a* in the ECU 8 forming the first air-fuel ratio control means.

Figure 4:
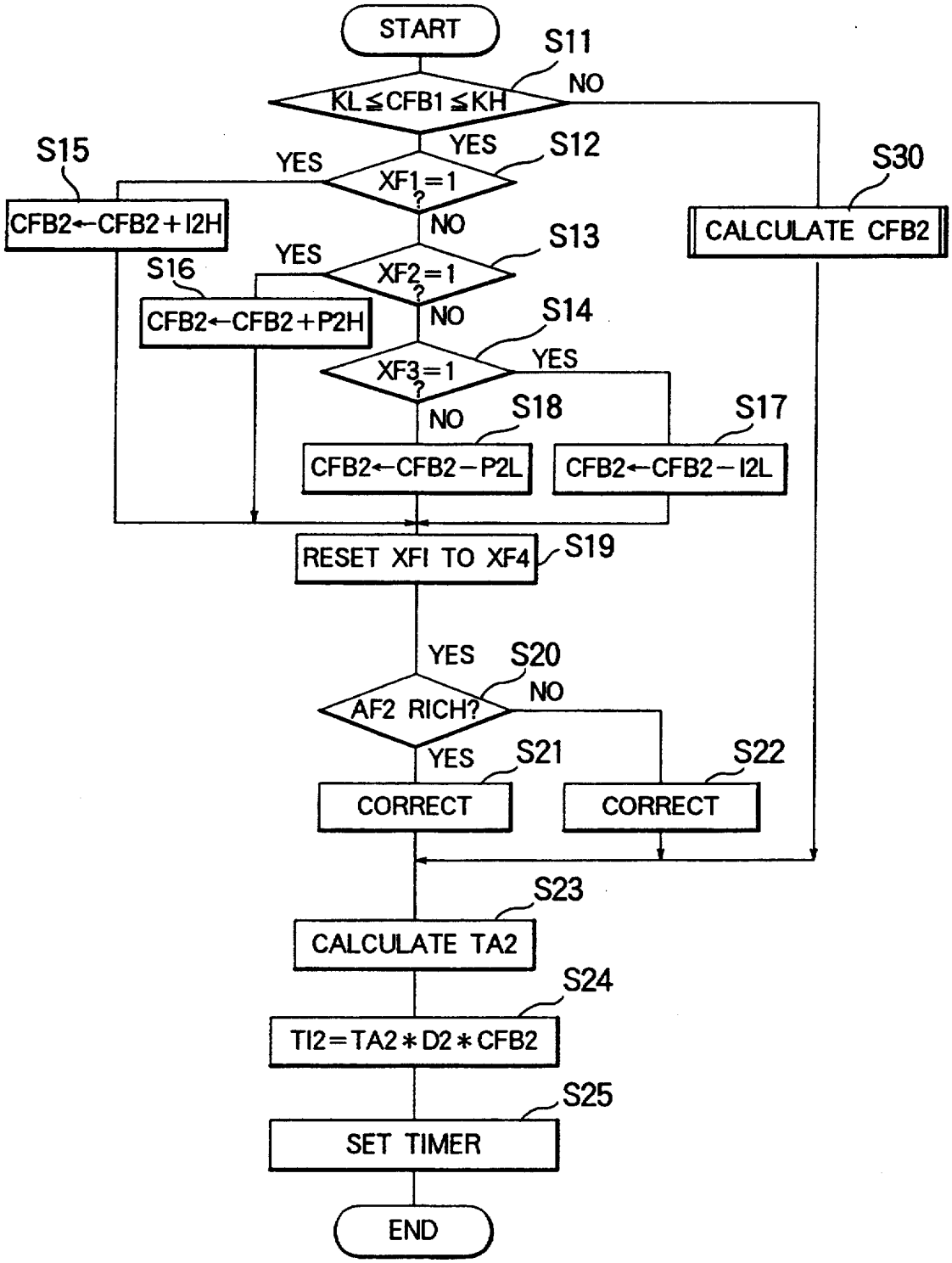
FIG. 4 is a flow chart which explains a second air-fuel ratio control operation according to the first embodiment of the present invention.

FIG. 4 is a flow chart of the fuel control operation of the second cylinder group 1*b*, the fuel control operation being executed after the crank shaft has been rotated for a predetermined angular degree (or a predetermined time has passed).

In step S11, whether or not the air-fuel ratio correction coefficient CFB1 is included in the following range is discriminated in order to discriminate whether or not the state of the air-fuel ratio of the first cylinder group 1*a* is included in a predetermined range:

$$KL \leqq CFB1 \leqq KH$$

where KL is a lower limit value about 0.5, KH is an upper limit value about 1.5, and the air-fuel ratio deviation quantity discrimination values KL and KH may arbitrarily set as desired.

That is, if the engine is being accelerated or decelerated, the air-fuel ratio is sometimes made rich or lean. Therefore, if the air-fuel ratio correction coefficient CFB1 is deviated from the foregoing range, a fact can be understood that considerable deviation of the air-fuel ratio has taken place due to the acceleration or the deceleration of the engine.

If the air-fuel ratio correction coefficient CFB1 is included in the foregoing range though an affirmative discrimination has been made in step S11, a discrimination is made that the air-fuel ratio of the first cylinder group 1*a* is not excessively deviated, and the flow proceeds to step S12. If a negative discrimination has been made (CFB1<KL or KH<CFB1), a discrimination is made that the air-fuel ratio of the first cylinder group 1*a* is considerably deviated due to the acceleration or the deceleration, and the flow proceeds to step S30 (to be described later).

In step S12, a discrimination is made whether or not the flag XF1 representing the continuation of the rich state of the air-fuel ratio signal AF1 is 1. If an affirmative discrimination has been made, that is, if XF1=1, the flow proceeds to step S15 in which the air-fuel ratio correction coefficient CFB2 for the fuel injection quantity to be injected from the injector 2*b* for the second cylinder group 1*b* is increased as follows:

$$CFB2 \leftarrow CFB2 + I2H$$

where I2H is an air-fuel ratio integration constant that can be corrected.

Then, the flow proceeds to step S19 to reset the flag to zero.

If a negative discrimination is made in step S12, that is, if XF1=0, the flow proceeds to step S13 in which a discrimination is made whether or not the flag XF2, which represents that the air-fuel ratio signal AF1 has been inverted to the rich state, is 1. If an affirmative discrimination has been made in step S13, that is, if XF2=1, the flow proceeds to step S16 in which the air-fuel ratio correction coefficient CFB2 for the fuel injection quantity to be injected from the injector 2*b* of the second cylinder group 1*b* is increased as follows:

$$CFB2 \leftarrow CFB2 + P2H$$

where P2H is an air-fuel ratio proportional constant (to be described later) that can be corrected.

Then, the flow proceeds to step S19 to reset the flag to zero.

If a negative discrimination is made in step S13, that is, if XF2=0, the flow proceeds to step S14 in which a discrimination is made whether or not the flag XF3 representing the continuation of the lean state of the air-fuel ratio signal AF1 is 1. If an affirmative discrimination has been made in step S14, that is, if XF3=1, the flow proceeds to step S17 in which the air-fuel ratio correction coefficient CFB2 for the fuel injection quantity to be injected from the injector 2*b* of the second cylinder group 1*b* is decreased as follows:

$$CFB2 \leftarrow CFB2 - I2L$$

where I2L is an air-fuel ratio integration constant (to be described later) that can be corrected.

Then, the flow proceeds to step S19 to reset the flag to zero.

If a negative discrimination has been made in step S14, that is, if XF3=0, it is apparent that the flag XF4 representing the inversion of the air-fuel ratio signal AF1 to the lean state is 1. Therefore, the flow proceeds to step S18 in which the air-fuel ratio correction coefficient CFB2 for the fuel injection quantity to be injected from the injector 2*b* of the second cylinder group 1*b* is decreased as follows:

$$CFB2 \leftarrow CFB2 - P2L$$

where P2L is an air-fuel ratio integration constant (to be described later) that can be corrected.

Then, the flow proceeds to step S19 to reset the flags XF1 to XF4 to zero.

The foregoing steps S12 to S18 are steps in which the process for calculating the air-fuel ratio correction coefficient CFB2 for the second cylinder group 1*b*, the phase of which is inverse to that of the air-fuel ratio correction coefficient CFB1 for the first cylinder group 1*a*. The foregoing process is executed by the main calculating portion 81A and the second correction portion 87*b* forming the second air-fuel ratio control means.

A routine (steps S20 to S22) for correcting the air-fuel ratio correction coefficient CFB2 to be executed by the air-fuel ratio correction portion 88 will now be described.

The flags XF1 to XF4 to which references have been made are reset to zero in step S19, and then a reference is made to the second air-fuel ratio signal AF2 in step S20 to discriminate whether or not the air-fuel ratio in the second cylinder group 1*b* is rich.

If an affirmative discrimination has been made, that is, if the air-fuel ratio signal AF2 is rich, the flow proceeds to step S21 in which the air-fuel ratio correction coefficient CFB2 is so corrected as to make the second air-fuel ratio signal AF2 to be lean.

The correction to be performed in step S21 for making the air-fuel ratio to be lean is carried out by using correction constant K1 to correct the air-fuel ratio correction coefficient CFB2, using correction constant K2 to correct the air-fuel ratio proportional constants P2L and P2H or correction constant K3 to correct the air-fuel ratio integration constants I2L and I2H. The correction is performed in accordance with any one of the following five types of calculations or their mixture shown as examples:

$$CFB2 \leftarrow CFB2 - K1$$

$$P2L \leftarrow P2L + K2$$

$$I2L \leftarrow I2L + K3$$

$$P2H \leftarrow P2H - K2$$

$$I2H \leftarrow I2H - K3$$

where each of the correction constants K1 to K3 may be set to an arbitrary value about 0.1 or less.

After the air-fuel ratio of the second cylinder group 2*b* has been corrected to be lean, the flow proceeds to step S23 for calculating the basic fuel injection quantity TA2.

If a negative discrimination has been made in step S20, that is, if the second air-fuel ratio signal AF2 is lean, the flow proceeds to step S22 in which the air-fuel ratio correction coefficient CFB2 is so corrected as to make the second air-fuel ratio signal AF2 to be rich.

The correction to be performed in step S22 for making the air-fuel ratio to be rich is carried out in accordance with any one of the following five types of calculations or their mixture shown as examples:

$$CFB2 \leftarrow CFB2 + K1$$

$$P2L \leftarrow P2L - K2$$

$$I2L \leftarrow I2L - K3$$

$$P2H \leftarrow P2H + K2$$

$$I2H \leftarrow I2H + K3$$

After the air-fuel ratio in the second cylinder group 2*b* has been corrected to rich as described above, the flow proceeds to step S23 for calculating the basic fuel injection quantity TA2.

In step S23 to be performed by the main calculating portion 81A, the basic fuel injection quantity TA2 to be injected from the injector 2*b* of the second cylinder group 1*b* is calculated in accordance with the sucked air quantity A and the crank angle signal $\theta$.

In next step S24 to be performed by the second correction portion 87*b* and the air-fuel ratio correction portion 88, the fuel correction coefficient D2 is obtained in accordance with the state where the internal combustion engine 1 is warmed up that can be obtained in accordance with the temperature T and the state where the internal combustion engine 1 is accelerated/decelerated that can be obtained from the change in the throttle opening $\alpha$. Further, the fuel injection quantity TI2 to be injected from the injector 2*b* is obtained in accordance with the following equation:

$$TI2 = TA2 \times D2 \times CFB2$$

Finally, the timer is so set as to enable the injector 2*b* to inject the fuel by the fuel injection quantity TI2 in step S25, while transmitting information about the timer as a second fuel injection signal C2' and the process is completed here.

As a result, the second cylinder group 1*b* is controlled to an inverse phase to the phase of the first air-fuel ratio and while having a predetermined air-fuel ratio. As a result, the effect of purifying the exhaust gas can be improved and the engine revolutions can be stabilized.

If exhaust gases discharged from the respective cylinder groups 1*a* and 1*b* are allowed to pass through the trinary catalysts 16*a* and 16*b* as shown in FIG. 1 for example, each gas periodically repeats the lean state and the rich state. Therefore, the purifying effect can be improved.

If a structure is formed as shown in FIG. 2 in such a manner that exhaust gases from the respective cylinder groups 1*a* and 1*b* are collectively allowed to pass through one trinary catalyst 16 by way of the common exhaust pipe 14, exhaust gases mutually having the inverse relationship between rich and lean are alternately discharged from the exhaust pipes 14*a* and 14*b*.

That is, a lean exhaust gas is discharged from the exhaust pipe 14*a* at a certain ignition timing, while a rich exhaust gas is discharged from the exhaust pipe 14*b* at the next ignition timing. Therefore, the purifying effect can further be improved.

Then, description will be made, with reference to a flow chart shown in FIG. 5, about a calculation routine using air-fuel ratio correction coefficient CFB2 to be performed in a case where a negative discrimination has been made (the first air-fuel ratio signal AF1 is not included in a predetermined range) in step S11 and therefore the flow has proceeded to step S30.

Calculation step S30 composed of steps S31 to S37 is a step in which the first air-fuel ratio signal AF1 is not used but only the second air-fuel ratio signal AF1 is used to control the air-fuel ratio of the second cylinder group 1*b* in a state where the air-fuel ratio of the first cylinder group 1*a* is considerably deviated.

The reason for this is as follows: if the air-fuel ratio of the second cylinder group 1*b* is controlled to be in the inverse phase to that of the first cylinder group 1*a* in the state where the air-fuel ratio of the first cylinder group 1*a* is considerably deviated, the air-fuel ratio of the second cylinder group 1*b* is undesirably and considerably deviated from an aimed air-fuel ratio.

Figure 5:
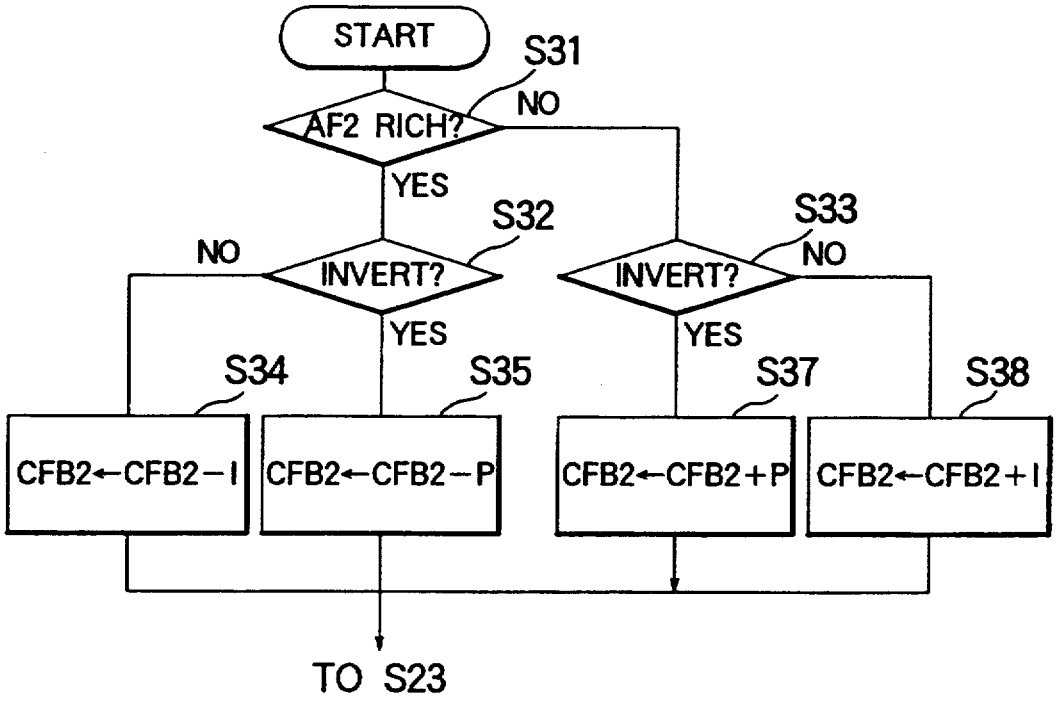
FIG. 5 is a flow chart which explains a second air-fuel ratio control operation according to the first embodiment of the present invention to be performed when the internal combustion engine is being accelerated or decelerated.
Figure 6:
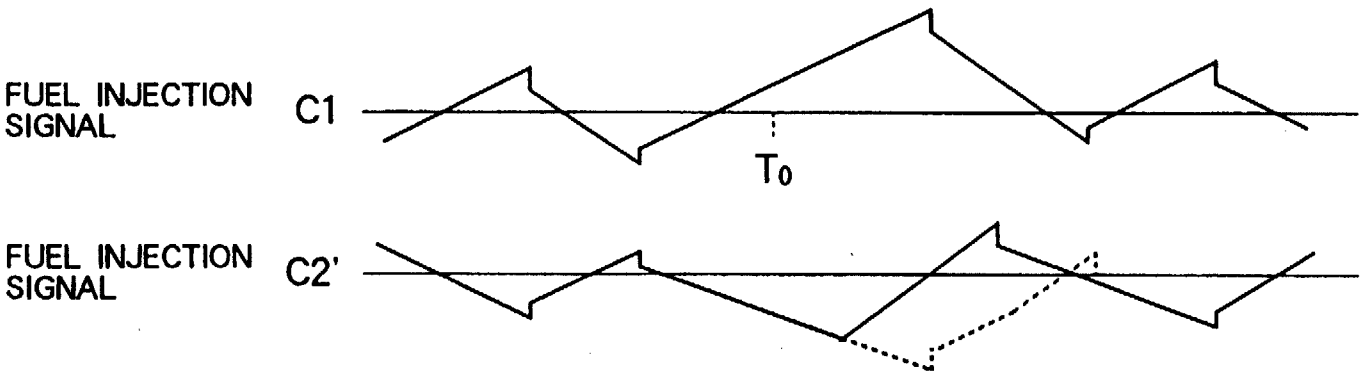
FIG. 6 is a waveform graph which explains a second air-fuel ratio control operation according to the first embodiment of the present invention to be performed when the internal combustion engine is being accelerated.

Steps S31 to S37 shown in FIG. 5 respectively correspond to steps S1 to S7 shown in FIG. 3.

First, the second air-fuel ratio signal AF2 is subjected to a comparison with a predetermined voltage level to make a discrimination whether or not the second air-fuel ratio signal AF2 is larger than the predetermined voltage level (whether the air-fuel ratio is rich or lean). If an affirmative discrimination has been made, a discrimination is made that the air-fuel ratio is rich. Therefore, the flow proceeds to step S32. If a negative discrimination has been made, a discrimination is made that the air-fuel ratio is lean, and the flow proceeds to step S33.

In step S32, a discrimination is made whether or not the second air-fuel ratio signal AF2 has been inverted from the lean state to the rich state. If an affirmative discrimination has been made, that is, if the air-fuel ratio has been inverted to the rich state, the flow proceeds to step S35 in which the second air-fuel ratio correction coefficient CFB2 set to the injector 2*b* of the second cylinder group 1*b* is decreased as follows, and the flow proceeds to step S23.

$$CFB2 \leftarrow CFB2 - P$$

If a negative discrimination has been made in step S32, that is, if the rich state has been maintained, the flow proceeds to step S34 in which the air-fuel ratio correction coefficient CFB2 is decreased as follows and the flow proceeds to step S23.

$$CFB2 \leftarrow CFB2 - I$$

In step S33 to be performed after the discrimination has been made that the second air-fuel ratio signal AF2 has been brought into the lean state, a discrimination is made whether or not the second air-fuel ratio signal AF2 has been inverted from the rich state to the lean state. If an affirmative discrimination has been made, that is, if the air-fuel ratio has been inverted to the lean state, the flow proceeds to step S37 in which the air-fuel ratio correction coefficient CFB2 is increased as follows, and the flow proceeds to step S23:

$$CFB2 \leftarrow CFB2 + P$$

If a negative discrimination has been made in step S33, that is, if the lean state has been continued, the flow proceeds to step S36 in which the air-fuel ratio correction coefficient CFB2 is increased as follows and the flow proceeds to step S23:

$$CFB2 \leftarrow CFB2 + I$$

As a result, the control of the second fuel injection signal C2' is shifted to the processing routine in step S30 if the first fuel injection signal C1 has considerably been controlled to the rich state in a state where acceleration has been performed at time to for example.

Therefore, the undesirable and considerable control of the second fuel injection signal C2' to the lean side as designated by a dashed line can be prevented, and accordingly it is controlled to the rich state as described by a continuous line. As a result, the air-fuel ratio can be controlled as desired.

Second Embodiment

The first embodiment is arranged in such a manner that the air-fuel ratio correction portion 88 makes a reference to the second air-fuel ratio signal AF2 in step S20 shown in FIG. 4, and correction step S21 or S22 is performed in accordance with the state of the air-fuel ratio, that is whether the air-fuel ratio is the rich state or the lean state. The reason for this is that the air-fuel ratio correction coefficients CFB1 and CFB2 in the first embodiment are in the inverse phases and therefore the arrangement making the air-fuel ratio to be the aimed air-fuel ratio causes the air-fuel ratio to be in the inverse phase.

As contrasted with the first embodiment, the second embodiment is arranged in such a manner that correction step S21 or S22 is performed in accordance with the result of a discrimination whether or not the phase is in an inverse state to the phase of the first air-fuel ratio signal AF1.

As a result, the second cylinder group 1*b* can further reliably be controlled to be the inverse state to the phase of the first cylinder group 1*a*.

Figure 7:
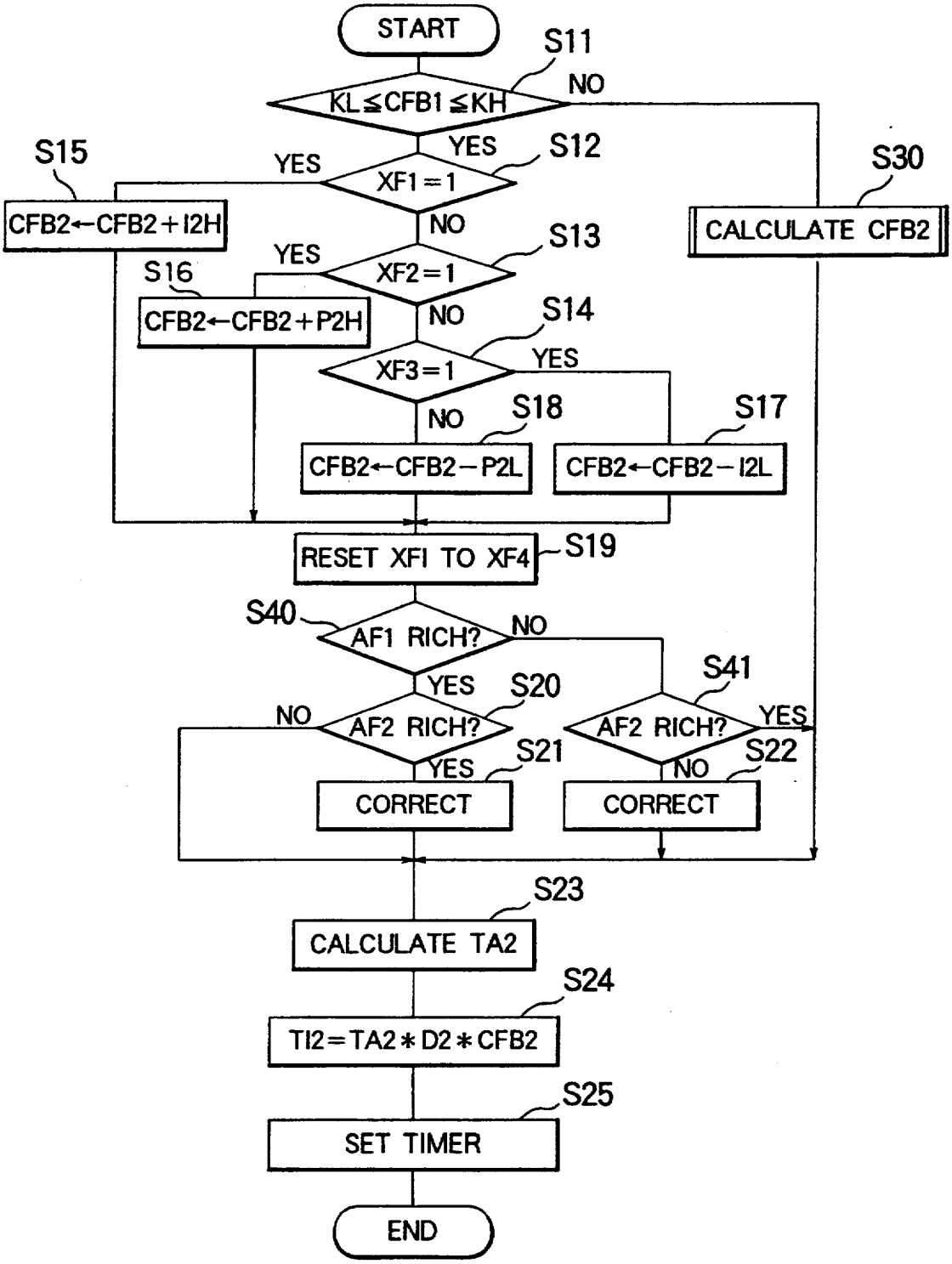
FIG. 7 is a flow chart which explains a second air-fuel ratio control operation according to a second embodiment of the present invention.

FIG. 7 is a flow chart which illustrates an air-fuel ratio correction routine according to the second embodiment (corresponding to claim 2) for correcting the air-fuel ratio of the second cylinder group 1*b*, wherein steps S11 to S23 are steps arranged similarly to those described above.

In this case, step S19 in which the flags XF1 to XF4 are reset is performed, and then a reference is made to the first air-fuel ratio signal AF1 in step S40 to make a discrimination whether or not the air-fuel ratio of the first cylinder group 1a is rich.

If an affirmative discrimination has been made in step S40, that is, if the air-fuel ratio is rich, the flow proceeds to step S20 in which a reference to the second air-fuel ratio signal AF2 is made as to make a discrimination whether or not the air-fuel ratio of the second cylinder group 1*b* is rich. If a negative discrimination is made in step S40, that is, if the air-fuel ratio is lean, the flow proceeds to step S41 in which a discrimination is made whether or not the second air-fuel ratio signal AF2 is rich.

If a negative discrimination is made in step S20, that is, if a discrimination is made that the air-fuel ratio is lean, the air-fuel ratio of the first cylinder group 1*a* and that of the second cylinder group 1*b* are made inverse, and accordingly no correction is required. Therefore, the flow proceeds to step S23. If an affirmative discrimination is made, that is, if the air-fuel ratio is rich, the flow proceeds to step S21 in which the air-fuel ratio is made to be lean similarly to the foregoing step as to make the air fuel ratios of the cylinder groups 1*a* and 1*b* to be inverse.

If an affirmative discrimination is made in step S41, that is, if the air-fuel ratio is rich, the air-fuel ratio of the first cylinder group 1*a* and that of the second cylinder group 1b are made inverse, and accordingly no correction is required. Therefore, the flow proceeds to step S23. If a negative discrimination is made in step S41, that is, if the air-fuel ratio is lean, the flow proceeds to step S22 in which the air-fuel ratio is so corrected to the rich state as to make the phase of the air-fuel ratio of the cylinder group 1*a* and that of the cylinder group 1*b* to be inverse.

Third Embodiment

Although each of the first and second embodiment is arranged in such a manner that the second air-fuel ratio correction coefficient CFB2 is controlled as to make the phase of the second air-fuel ratio signal AF2 to be inverse to the phase of the first air-fuel ratio signal AF1, control of the same to be different from the phase of the first air-fuel ratio signal AF1 in place of the completely inverse phase control, of course, enables a certain effect to be obtained.

Fourth Embodiment

Although each of the foregoing embodiments is arranged in such a manner that the first cylinder group 1*a* is made to be the main group and the second cylinder group 1*b* is made to be the follower group to control the air-fuel ratio of each of the cylinder groups 1*a* and 1*b* in accordance with the first air-fuel ratio signal AF1, the air-fuel ratio of each of the cylinder groups 1*a* and 1*b* may be controlled in accordance with the second air-fuel ratio signal AF2 while making the second cylinder group 1*b* to be the main group and the first cylinder group 1*a* to be the follower group.

Fifth Embodiment

Each of the foregoing embodiments is arranged in such a manner that the following steps are performed at the timing at which the processes shown in FIGS. 3 to 5 and 7: steps S1, S20, S31 and S40, in which the discrimination is made whether or not the air-fuel ratio of each of the air-fuel ratio signals AF1 and AF2 has been made to be rich and steps S2, S3, S32 and S33 in which the discrimination is made whether or not the air-fuel ratio has been inverted from the rich state to the lean state or the same has been inverted from the lean state to the rich state. However, the foregoing steps may be performed at predetermined moments individually from the processes shown in FIGS. 3 to 5 and 7 while using the results of noise treatment and delay treatment.

Sixth Embodiment

Figure 8:
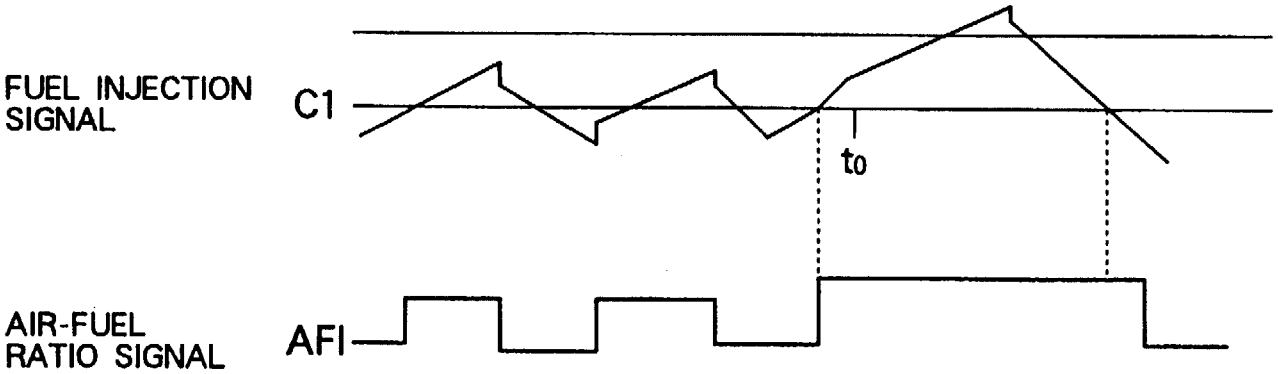
FIG. 8 is a waveform graph which explains an operation for discriminating the state of the air-fuel ratio of the first cylinder group according to a sixth embodiment of the present invention.

Each of the foregoing embodiments is arranged in such a manner that the state of the deviation of the air-fuel ratio of the first cylinder group 1*a* is discriminated in accordance with the range of the first air-fuel ratio correction coefficient CFB1 in step S11 shown in FIGS. 4 and 7. However, the discrimination may be made in accordance with time (cycle) taken for the air-fuel ratio of the air-fuel ratio signal AF1 to be inverted from the rich state to the lean state or from the lean state to the rich state or in accordance with the deviation of the air-fuel ratio correction coefficient CFB1 from an average value for a predetermined time as shown in FIG. 8.

Seventh Embodiment

Each of the foregoing embodiment is arranged in such a manner that the air-fuel ratio is controlled to be the theoretical air-fuel ratio, the present invention may be employed also in a case where a linear air-fuel ratio sensor or the like is use to control the air-fuel ratio to be an arbitrary air-fuel ratio except the theoretical air-fuel ratio.

What is claimed is:

1. An air-fuel ratio control apparatus for an internal combustion engine for controlling the air-fuel ratio of a first cylinder group and a second cylinder group, said air-fuel ratio control apparatus for an internal combustion engine comprising:
   - a first air-fuel ratio sensor disposed in an exhaust system of said first cylinder group;
   - a second air-fuel ratio sensor disposed in an exhaust system of said second cylinder group;
   - first air-fuel ratio control means for controlling said air-fuel ratio of said first cylinder group to be a predetermined air-fuel ratio in accordance with a first air-fuel ratio signal supplied from said first air-fuel ratio sensor;
   - second air-fuel ratio control means for controlling said air-fuel ratio of said second cylinder group to be a phase different from the phase of said air-fuel ratio of said first cylinder group in accordance with said first air-fuel ratio signal; and
   - air-fuel ratio correction means for correcting said air-fuel ratio of said second cylinder group to be a predetermined air-fuel ratio in accordance with a second air-fuel ratio signal supplied from said second air-fuel ratio sensor.

2. An air-fuel ratio control apparatus for an internal combustion engine according to claim 1 wherein said air-fuel ratio correction means comprises
   - inverse phase discrimination means for discriminating whether or not said air-fuel ratio of said first cylinder group and that of said second air-fuel ratio are in an inverse phase state; and
   - correction means for correcting the phase of said air-fuel ratio of said second cylinder group to be inverse to the phase of said air-fuel ratio of said first cylinder group if said air-fuel ratio of said first cylinder group and that of said second cylinder group are not inverse phase state in accordance with the results of discriminations made by said inverse phase discrimination means.

3. An air-fuel ratio control apparatus for an internal combustion engine according to claim 1 further comprising a common exhaust pipe for collecting said exhaust system of said first cylinder group and that of said second cylinder group, and a trinary catalyst disposed downstream from said common exhaust pipe.

4. An air-fuel ratio control apparatus for an internal combustion engine according to claim 1 further comprising:

predetermined air-fuel ratio state discrimination means for discriminating whether or not the state of said air-fuel ratio of said first cylinder group is included in a predetermined range;

air-fuel ratio control switch means for controlling said air-fuel ratio of said second cylinder group to be a predetermined air-fuel ratio in accordance with only said second air-fuel ratio signal if the state of said air-fuel ratio of said first cylinder group is deviated from said predetermined range in accordance with the result of a discrimination made by said air-fuel ratio state discrimination means.

* * * * *